United States Patent [19]

Hinterholzer

[11] Patent Number: 4,702,639

[45] Date of Patent: Oct. 27, 1987

[54] SLALOM POST

[76] Inventor: Hans Hinterholzer, Niels Juelsgt 36c, 0272 Olso 2, Norway

[21] Appl. No.: 771,437

[22] Filed: Aug. 30, 1985

[30] Foreign Application Priority Data

Mar. 9, 1984 [AT] Austria ..... 2809/84

[51] Int. Cl.[4] ..... E01F 9/01; A63C 19/10

[52] U.S. Cl. ..... 404/10; 52/159; 52/165; 116/209; 272/3; 272/56.5 S S

[58] Field of Search ..... 135/118; 52/153, 154, 52/155, 156, 157, 158, 159, 160, 161, 162, 163, 164, 165, 166; 272/3, 56.5 S S; 280/819; 116/173, 209, 63 P; 404/9, 10, 11; 248/156, 545

[56] References Cited

U.S. PATENT DOCUMENTS

| | | | |
|---|---|---|---|
| 510,625 | 12/1893 | Wright | 52/154 |
| 857,751 | 6/1907 | Parker | 52/156 |
| 998,720 | 6/1911 | Simpson | 135/118 X |
| 1,343,384 | 6/1920 | Blackburn | 52/157 X |
| 1,742,162 | 12/1929 | Birkenmaier | 52/159 |
| 1,781,350 | 11/1930 | Taylor | 135/118 |
| 2,899,029 | 8/1959 | Ballew | 52/159 |
| 2,999,572 | 9/1961 | Hinckley | 52/156 |
| 3,519,234 | 7/1970 | Matson | 248/156 |
| 3,727,357 | 4/1973 | Stillman, Jr. | 52/155 X |
| 3,778,944 | 12/1973 | Easley | 52/159 |
| 3,965,596 | 6/1976 | Schröcksnadel | 404/9 X |
| 4,491,438 | 1/1985 | Berutti | 404/10 |
| 4,588,324 | 5/1986 | Goellner | 404/10 |

FOREIGN PATENT DOCUMENTS

| | | | |
|---|---|---|---|
| 63254 | 10/1982 | European Pat. Off. | 272/3 |
| 233100 | 10/1911 | Fed. Rep. of Germany | 52/160 |
| 28581 | of 1911 | United Kingdom | 135/118 |
| 2021175 | 11/1979 | United Kingdom | 52/157 |
| 586269 | 12/1977 | U.S.S.R. | 52/162 |

*Primary Examiner*—Richard T. Stouffer

*Attorney, Agent, or Firm*—Kirkpatrick & Lockhart

[57] ABSTRACT

A slalom post (1) is described at the bottom end of which an anchoring element (3) shaped as a flange (3) is provided collaborating with a protection wedge (7). The flange (3) may be moved from a non-effective position when the flange (3) is within the profile of the protection wedge (7) into an effective position when it projects beyond the profile of the slalom post. In this way, a structurally simple, easily operable and very effective anchoring of the slalom post is obtained.

12 Claims, 8 Drawing Figures

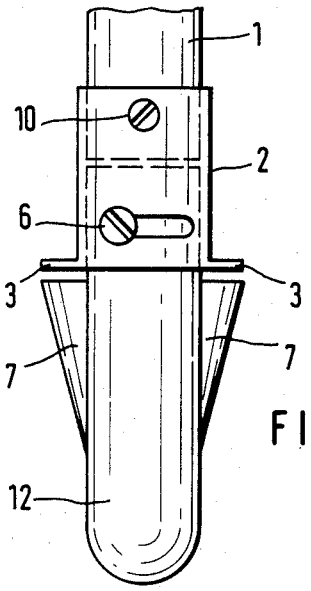
FIG. 4
FIG. 5
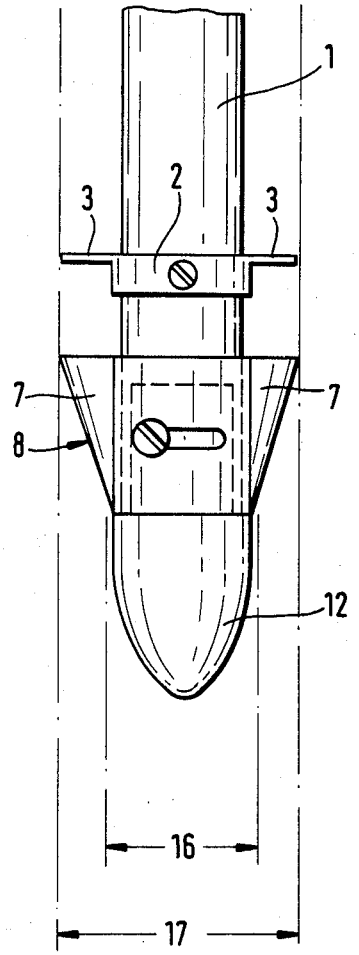
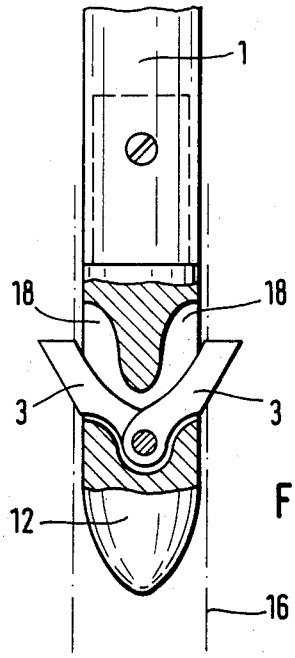
FIG. 6

SLALOM POST

BACKGROUND OF THE INVENTION

1. Field of the Invention

The present invention relates to a slalom post.

2. Description of the Prior Art

In the use of slalom posts, it is a problem that the slalom posts pushed into the snow broke loose from their anchorage in the snow after a few more or less severe collisions by the racers and had to be reinserted into the anchoring hole again. This not only led to the disadvantage of an interruption of the race but also constituted a serious danger to the racers as well as to the spectators.

Prior art slalom posts namely comprise a smooth bottom end. If necessary, they are pointed at the end. Embodiments have been known where the point lower end of the slalom post was provided with a rough thread to be able to screw the slalom post into a prepared hole such that when rotating the slalom post, the latter went, for a relatively short distance, into the snow masses. All prior art slalom posts however show the disadvantages mentioned above.

It is therefore the aim of the present invention to suggest a slalom post, which while simple in structure is characterized in that it is safely anchored in its hole in the snow. If above, and in the following, snow is referred to, one has to understand hereunder all compositions of snow and ice into which slalom posts, when used, are inserted.

SUMMARY OF THE INVENTION

To solve this problem, the invention is characterized in that in the area of the bottom end of the slalom post at least one anchoring element is provided, which can be moved from a non-effective position into an effective position projecting with at least one anchoring face essentially rectangular relative to the axis of the slalom post beyond the profile of the slalom post.

Normally, a hole having approximately the diameter of the slalom post is made in the snow by means of a borer and the slalom post is then inserted into this hole. In this case, the anchoring element is in its non-effective position thus making the insertion of the lower end of the slalom post into the hole earlier made easier. Subsequently, the anchoring element, as will later on be described in more detail, is brought into its effective position in which it causes an effective anchorage and fixation of the slalom post within the snow hole, because the anchoring element will anchor and clamp into the snow masses surrounding the hole. Experiments have shown that the slalom post according to the invention will easily stand the normal strains without being torn out of the snow hole.

If after the end of the race the slalom post is to be drawn from the hole, the anchoring element need only be brought into its non-effective position and the post can easily be drawn out without any auxiliary means.

There are several possibilities to move the anchoring element from its non-effective into its effective position and vice versa. The anchoring element may for instance be provided on the slalom pole tiltably around an axis which is essentially radially directed through the slalom pole. In a preferred embodiment, however, the anchoring element is torsionally stably secured to the slalom post and is shaped as a laterally projecting flange where a protection wedge is secured to the slalom post rotatable relative thereto, the greatest cross sectional profile of which protection wedge approximately corresponds to the flange. Thus when inserting and/or withdrawing the flange (this will later on be explained in more detail), the protection wedge, with its greatest cross sectional profile facing the flange will protect the flange and thus make insertion of the flange, or anchoring element, and/or its undisturbed withdrawal together with the slalom post possible. The rotational movement necessary can very simply be made because it is the slalom post itself which has to be twisted around a certainn angle, for instance 90° around itself when in the state inserted in the hole. The flange forming the anchoring element will then arrive in its effective position.

It is possible to provide the protection wedge either above or below the flange. If the protection wedge is below the flange, the protection wedge, when inserting the slalom post into the hole, will trace a path into the snow masses surrounding the bore so that the flange will not be bent. In this embodiment, the protection wedge is so arranged that it is tapered towards the point. This makes insertion of the slalom post into the snow hole substantially easier.

In another essential and preferred embodiment, the protection wedge is reversely arranged, i.e. it is, at a relatively short distance, directly above the flange. When inserting the slalom post in the snow hole, it protects the flange from bending. It is still more important that when withdrawing the slalom post, the wedge face then showing upwardly makes such withdrawal easier while little force is required. In addition, this second arrangement with the flange provided below makes possible that the flange is directly secured to the slalom post at the lower-most portion of it. This leads further on to the important advantage that the whole bore in the snow may be used for anchorage because the flange effecting the anchorage has the whole depth of the bore in the snow over it. In the first-mentioned embodiment where the flange is provided at a certain distance above the lower point or the lower end of the slalom post, the distance is lost for proper anchorage.

It is common to both embodiments that the flange is torsionally stably secured to the slalom post while the anchoring wedge is rotatably secured to a bushing on the slalom post.

It should be noted that obviously a plurality of anchoring elements or flanges respectively may be provided as well. This increases the anchorage effect. This is especially the case if the anchoring elements or flanges respectively, are pair-wisely provided on opposite sides of the slalom post. They may also be provided one above the other, which however is not so effective.

The mounting of the protection wedge is effected in a constructively simple way by means of a bushing pushed over the slalom post. It is also of advantage if the bushing and the protection wedge itself are integrally produced as one piece from suitable plastic material (injection molding).

The protection wedge is to be turned relative to the fixed flange at a predetermined angle each, normally at about 90°; it may however be larger as well, for instance, 180°. In order to obtain this in a constructively simple way, it is further an advantage if an oblong hole is provided in the bushing extending in approximately peripheral direction through which a holding screw screwed into the slalom post is arranged which has a head thicker than the width of the oblong hole. Other means for fixing the torsion angle are possible as well, for instance by providing the bushing mentioned with a step opposite a further bushing solidly secured to the slalom post and also having a step, etc.

There are also slalom posts having a hinge-like joint in the lower portion of the slalom post between a lower and an upper slalom post portion in order to render tilting of the upper slalom post portion easier. If a racer collides with such a slalom post, the latter tilts slightly above the ground thus substantially avoiding the danger of injuries that may occur in case of one-piece but flexible slalom posts. Such so-called tilting slalom posts are of disadvantage for the present invention because the hinge-like joint avoids, or at least renders difficult a twisting of the slalom post necessary for swivelling the flange. In order to solve this problem, such a tilting slalom post is characterized in accordance with the invention in that means engage in the two joining ends of the two slalom post portions preventing a twisting of the two slalom post portions relative to each other.

These means can so be provided that the joining ends of the slalom post portions are serrated. Such serration may directly be provided at these ends or on plates rendering the tilting movement possible.

Alternatively, or in addition thereto, such means may also be provided by a rubber-elastic bushing pushed over the ends of the two slalom post portions and connected to the ends. The rubber-elastic material of the bushing, now as before, permits the hinge-like movement of the two slalom post portions relative to each other, but at the same time also the twisting of the slalom post in itself because when twisting, the bushing is loaded in tangential direction only.

BRIEF DESCRIPTION OF THE DRAWINGS

The invention will now be explained in more detail in connection with exemplified embodiments from which further important features can be taken.

FIG. 4 is a view corresponding to FIG. 1 in a third embodiment;

FIG. 5 is a view corresponding to FIG. 1 in a further embodiment;

FIG. 6 is a view of the lower portion of a tiltable slalom post according to the invention in a first embodiment;

DETAILED DESCRIPTION OF THE PREFERRED EMBODIMENTS

Figure 1:
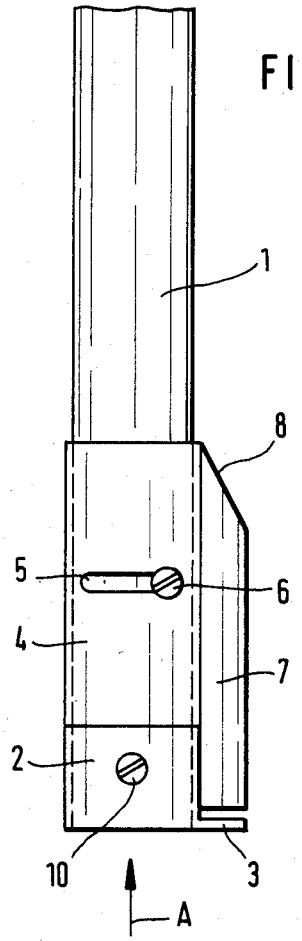
FIG. 1 is a view of the lower end of a slalom post according to the invention in the non-effective position of the anchoring element.
Figure 2:
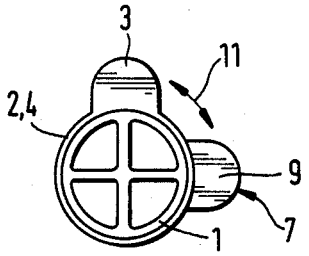
FIG. 2 is a view in the direction of arrow A of FIG. 1 but in the effective, i.e. twisted, position of the anchoring element.

FIGS. 1 and 2 describe the optimum solution of the problem. They show a slalom post 1 to the lower end of which, over a bushing 2, a flange 3 is secured, the face of which is approximately perpendicular to the axis of post 1. The flange is thus torsionally stably screwed to the post.

Directly above bushing 2, a further bushing 4 is provided which however is pushed, with a tolerance, over the lower end of slalom post 1. In bushing 4, an oblong hole 5 is provided into which a holding screw 6 is screwed, the head of which is thicker than the width of the oblong hole 5.

Integrally to one side of bushing 4, a protection wedge 7 is provided the wedge face 8 of which, in this embodiment, shows upwardly so that the wedge, upwardly flattened, lies against post 1. At the bottom, wedge 7 has its largest cross section area 9 (compare also FIG. 2). This cross sectional area is approximately as large and equally shaped as flange 3.

Thus it can be seen that, in the preferred embodiment, the essential functional elements of the anchorage of the invention comprise only flange 3 together with its bushing 2, wedge 7 together with its bushing 4 and fastening screw 6 as well as a fastening screw 10 for bushing 2.

For the anchorage of the slalom post, to start with, a hole is bored into the snow by means of a suitable borer and in a predetermined depth having approximately the diameter of the slalom post 1, if necessary somewhat larger. The slalom post is then pushed into the hole; flange 3 is directly under wedge 7 and thus protected from bending. If necessary, the flange may be produced from a material having such a thickness that bending cannot take place even without such protective effect because there is a certain space between the upper side of flange 3 and the lower side of wedge 7.

When the slalom post has been pushed to the predetermined depth in the hole, post 1 is twisted in the direction of arrow 11 in FIG. 2 thus twisting flange 3 into the position shown in FIG. 2, i.e. out of the profile of wedge 7. In this position, the slalom post is anchored in the snow hole because the whole height of the snow masses corresponding to the depth of the hole is now above flange 3.

A corresponding flange and a corresponding protection wedge may also be provided at the other side of post 1, or bushing 4, respectively, so that such flanges or anchoring elements respectively are provided on two opposite sides of the slalom post thus increasing the anchoring effect quite substantially. Any number of anchoring elements may, in principle, be used; also the anchoring elements may be arranged one above the other as will later on be described in more detail.

Figure 3:
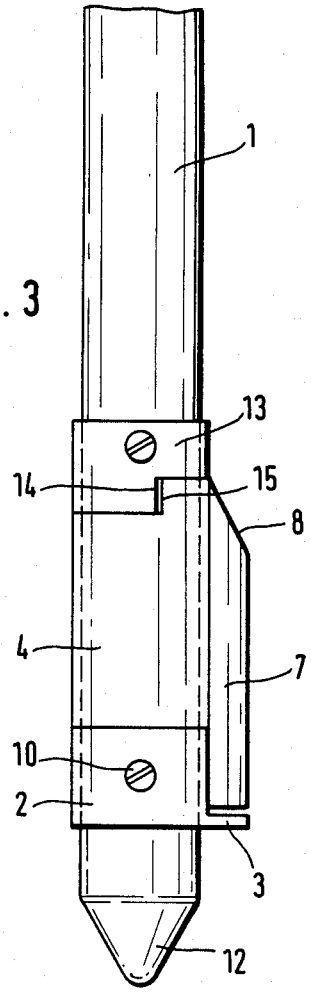
FIG. 3 is a view corresponding to FIG. 1 in a second embodiment.

The embodiment according to FIG. 3 is in principle similar to those of FIGS. 1 and 2. Here, it is only shown that slalom post **1*a* may also terminate in a point 12. While this offers advantages when pushing the slalom post into the snow, the corresponding height is lost for anchoring because flange 3** is no longer provided at the lower-most end of the post.

In addition, FIG. 3 shows that instead of the twist limitation by oblong hole 5 and screw 6, a further bushing 13 may be provided on post 1 including a shoulder 14 contacting a counter shoulder 15 of bushing **4*a***.

The embodiment according to FIG. 4 deviates from those of FIGS. 1 through 3 insofar as in this case protection wedge **7*b* is provided below flange 3*b* by correspondingly shaping point 12*b* of slalom post 1*b*. Moreover, flange 3*b* and protection wedge 7*b* are provided in pairs. In this case, the protection wedge 7*b* serves as a protection for the flange 3*b* when inserting the post and the protection wedge 7*b* is torsionally stably connected to the post 1*b* while the flange 3*b* via its bushing 2*b* is held, rotatably around a predetermined angle, to the slalom post 1*b***.

A similar embodiment is shown by FIG. 5 where, by 16, the diameter of the hole made by the borer is additionally given and, by 17, the trace made by the wedges in the snow passing in longitudinal direction to the predetermined depth. In the embodiment, the flanges 3*c* are again torsionally stably secured to post 1*c* and the wedges 7*c* are twistable relative thereto.

The embodiment according to FIG. 6 shows pairs of lugs and flanges 3*d* one upon the other which again are torsionally stably secured to post 1*d*. In this embodiment it is important that it depicts a so-called tilting slalom post comprising a lower portional post 19 and an upper portional post 20. The two portional posts are tiltably connected to each other via a rubber-elastic element 21 pushed into their ends. In accordance with the inventon, a twisting safety means is provided comprising either a serration 22 of the ends of portional posts 19, 20 and/or a rubber-elastic bushing 23, which is tightly connected to the ends of the two portional posts 19, 20. It should be noted that the serration 22 need not have the profiling as shown in the drawing. The teeth may rather also include flanks directed essentially along the longitudinal axis of the post.

Figure 7:
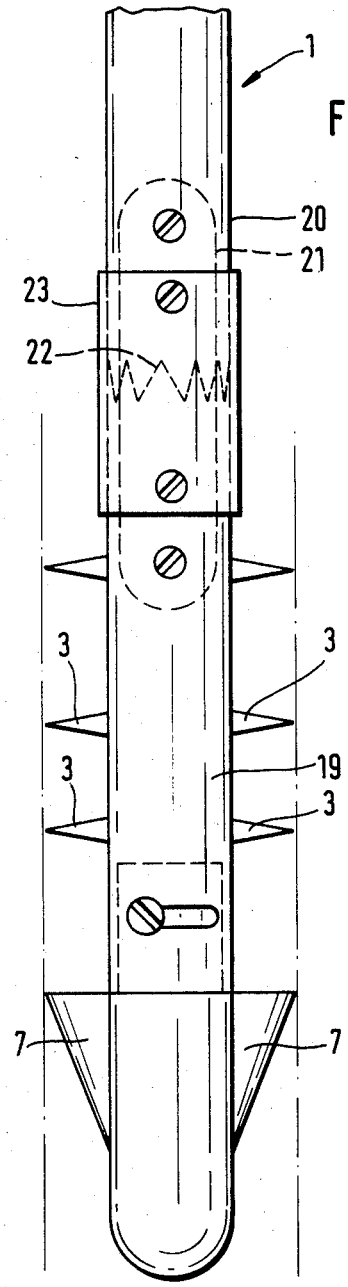
FIG. 7 is a view corresponding to FIG. 7 of a second embodiment of a tilting slalom post according to the invention.

FIG. 7, finally, shows an alteration of this principle where the tilting element is made up of a plurality of plates 24 arranged one above the other between the ends of portional posts 19, 20. They are held together by bushing 25. In accordance with the invention, the plates 24 include serration 22*e*. Bushing 25 too, may, as in FIG. 6, consist of the rubber-elastic material of bushing 23.

Figure 8:
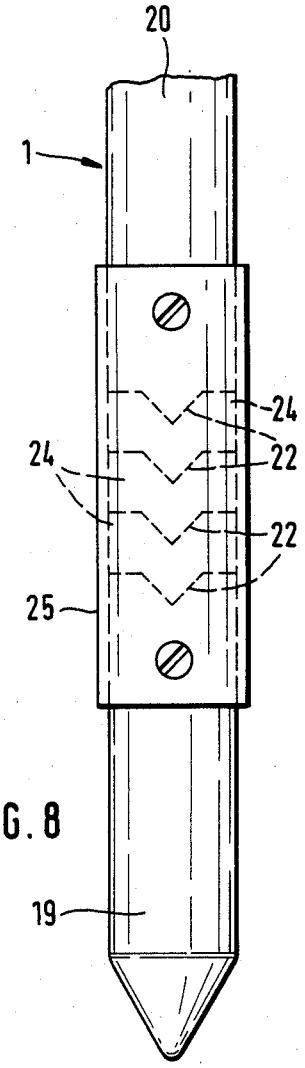
FIG. 8 is a further altered embodiment.
Figure 9:
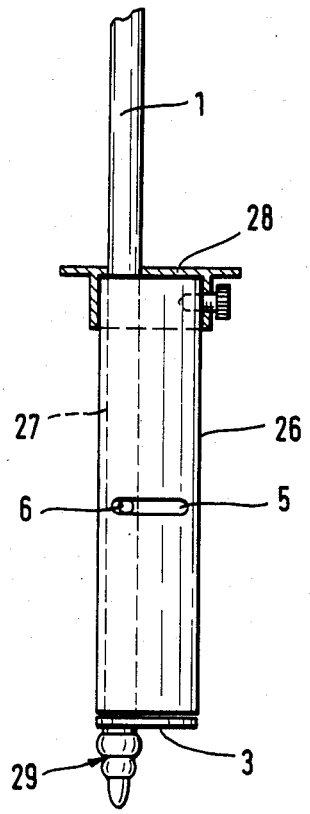

FIG. 8 shows an embodiment where in place of the protection wedge 7 including its bushing 4 according to FIGS. 1 and 2, a protection wedge may be substituted where a bushing 26 is provided having an eccentric longitudinal bore 27 into which the slalom post 1*f* is inserted. Flange 3*f* again secured to the lower end of slalom post 1*f* is so shaped that it is covered by the bushing 26 when in the swung-in and non-effective position as shown on the drawing. When twisting slalom pole 1f together with its flange 3*f* from this position around approximately 180°, the flange will take its effective position.

In order to avoid moving of bushing 26, it has preferably a non-circular profile or even projections by means of which the bushing grips into the surrounding snow.

At the upper end of bushing 26, a flange 28 projection beyond its profile is provided. It serves for limiting the inserting depth of slalom post 1*f* so that flange 3*f* may more easily be twisted into the snow.

At the lower end of slalom post 1*f* or flange 3*f*, respectively, a point 29 having a corrugated profile is provided making it possible to try insertion of the slalom post into the snow without an anchoring hole. This makes the tracing of a racing course easier.

The embodiments according to FIGS. 1, 2 and 8 are preferred.

What is claimed is:

1. A slalom post having a bottom end, said slalom post comprising:

a. at least one anchoring element connected to said slalom post in the area of said bottom end, each said anchoring element comprising a laterally projecting substantially horizontally flat flange extending perpendicular to the vertical axis of said post and torsionally stably secured to and extending outwardly beyond the cross-sectional profile of said post; and b. at least one protection wedge rotatably attached to said post adjacent said flange for rotation about the axis of said post, holding means preventing said protection wedge from moving along said axis of said post, the direction of the longest dimension of said wedge being parallel to the axis of said post with the protection wedge having a cross-sectional profile perpendicular to said post axis, said profile being approximately the same shape and size as said projecting flange, the wedge and flange being aligned with the post is forced into the snow such that said wedge protects said flange from bending, and then on rotation of said post about its axis once said post has been forced into the snow the relative rotation of said flange and wedge exposes said flange so that it acts to prevent the slalom post being pulled from the snow.

2. The Slalom post according to claim 1 wherein said protection wedge is arranged directly above said flange, the greatest cross sectional profile of said protection wedge facing said flange and the other end of said protection wedge being flattened and gradually angled inward towards said slalom post.

3. The Slalom post according to claim 1 wherein said protection wedge is secured to a rotatable bushing provided over said slalom post.

4. The Slalom post according to claim 3 wherein said bushing has an oblong hole extending peripherally about said bushing, and said holding means comprises a holding screw screwed into said slalom post and having a head thicker than the width of said oblong hole is arranged through said oblong hole.

5. The Slalom post according to claim 1 wherein said anchoring element is secured to the lower-most end of said slalom post.

6. The slalom post according to claim 1 wherein said slalom post further comprises a lower portion, an upper portion and a hinge-like joint between said lower and upper portions for permitting said upper portion to tilt relative to said lower portion, and means engaging said lower and upper portions for preventing a twisting of said lower and upper portions relative to each other.

7. The Slalom post according to claim 6 further comprising a rubber-elastic bushing positioned over and connected to the adjoining ends of said lower and upper portions.

8. The Slalom post according to claim 6 wherein said lower and upper portions have serrated joining ends.

9. The Slalom post according to claim 8 wherein said serrated joining ends are plates rendering the tilting movement possible.

10. The Slalom post according to claim 1 wherein said protection wedge is shaped as a bushing having an eccentric bore to receive said slalom post.

11. The Slalom post according to claim 10 wherein the profile of said bushing is non-circular.

12. The Slalom post according to claim 10 wherein a second flange is secured to the upper end of said bushing extending beyond the profile thereof.

* * * * *